US009677213B2

(12) United States Patent
De Pellegrin et al.

(10) Patent No.: US 9,677,213 B2
(45) Date of Patent: Jun. 13, 2017

(54) LAUNDRY TREATMENT DEVICE HAVING A CONTROL PANEL ASSEMBLY

(71) Applicant: Electrolux Appliances Aktiebolag, Stockholm (SE)

(72) Inventors: Andrea De Pellegrin, San Quirino (IT); Stefano Morandini, San Vito al Tagliamento (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/911,913

(22) PCT Filed: Jul. 29, 2014

(86) PCT No.: PCT/EP2014/066240
§ 371 (c)(1),
(2) Date: Feb. 12, 2016

(87) PCT Pub. No.: WO2015/022181
PCT Pub. Date: Feb. 19, 2015

(65) Prior Publication Data

US 2016/0194805 A1 Jul. 7, 2016

(30) Foreign Application Priority Data

Aug. 13, 2013 (EP) ..... 13180219

(51) Int. Cl.
*D06F 29/00* (2006.01)
*D06F 39/00* (2006.01)
(Continued)

(52) U.S. Cl.
CPC ..... *D06F 39/005* (2013.01); *D06F 29/005* (2013.01); *D06F 39/02* (2013.01);
(Continued)

(58) Field of Classification Search
CPC ..... D06F 39/005; D06F 39/02; D06F 39/022; D06F 39/14; D06F 58/28; D06F 2058/2803; D06F 37/26
See application file for complete search history.

(56) References Cited

U.S. PATENT DOCUMENTS

2005/0178164 A1 8/2005 Kim et al.
2005/0284194 A1* 12/2005 Kim ..... D06F 39/081 68/17 R
(Continued)

FOREIGN PATENT DOCUMENTS

DE 10050264 A1 4/2002
DE 202006006612 U1 8/2006
(Continued)

OTHER PUBLICATIONS

International Search Report mailed Sep. 19, 2014 in corresponding International Application No. PCT/EP2014/066240.
(Continued)

*Primary Examiner* — Daniel Rohrhoff
(74) *Attorney, Agent, or Firm* — Banner & Witcoff, Ltd.

(57) ABSTRACT

A laundry treatment device (100) includes a casing (2) with a front wall (4) defining a continuous front surface (4*a*). The front surface (4*a*) has a laundry opening (3*a*) to load and/or unload a laundry treatment chamber (12) contained in the casing (2). The casing (2) includes a panel aperture (15) having an edge defining a closed curve. A control panel assembly (1) is provided for controlling operation of the laundry treatment device (100). The control panel assembly includes an outer dashboard (11) which is structured to be coupled to the front wall (4) at the panel aperture (15) and to be operated by a user. The outer dashboard includes a dashboard external portion (11*ext*). The portion (11*ext*) is, in an assembled configuration, external to the casing, visible and accessible to a user. A drawer (63) is provided as well
(Continued)

as a drawer seat (61) to house the drawer. The drawer seat is fixed or fixable to the front wall so that the drawer is coupled in a retractable manner to the front wall (4). The drawer seat (61) is an integral piece of the external dashboard portion (11*ext*) forming an outer dashboard assembly (11*ext,* 61).

15 Claims, 9 Drawing Sheets

(51) Int. Cl.
*D06F 39/02* (2006.01)
*D06F 39/12* (2006.01)
*D06F 58/28* (2006.01)

(52) U.S. Cl.
CPC ..... *D06F 39/12* (2013.01); *D06F 58/28* (2013.01); *D06F 2058/2803* (2013.01)

(56) References Cited

U.S. PATENT DOCUMENTS

2007/0056329 A1* 3/2007 Song ..... D06F 39/02 68/17 R
2008/0078211 A1* 4/2008 Je ..... D06F 39/02 68/17 R
2010/0025214 A1 2/2010 Roose et al.
2012/0056827 A1* 3/2012 Kim ..... D06F 39/005 345/173
2012/0174632 A1* 7/2012 Sung ..... D06F 39/022 68/17 R
2014/0190220 A1* 7/2014 Lee ..... D06F 39/02 68/17 R
2016/0153133 A1* 6/2016 Del Pos ..... D06F 39/005 68/12.18
2016/0186369 A1* 6/2016 De Pellegrin ..... D06F 39/12 68/212

FOREIGN PATENT DOCUMENTS

DE 102008027726 B3 10/2009
EP 2140058 A2 1/2010
EP 2339063 A2 6/2011
EP 2415925 A1 2/2012
GB 1554725 A 10/1979
WO 2011128745 A2 10/2011

OTHER PUBLICATIONS

International Search Report mailed Sep. 16, 2014 in related International Application No. PCT/EP2014/066242.

* cited by examiner

LAUNDRY TREATMENT DEVICE HAVING A CONTROL PANEL ASSEMBLY

FIELD OF THE INVENTION

The present invention generally relates to laundry treatment devices, such as front loading washing machines, washers/dryers, dryers, both for domestic and professional use. More particularly, the present invention relates to a laundry treatment device including a control-panel assembly.

BACKGROUND OF THE INVENTION

It is known that the aesthetical appearance of laundry treatment devices is important and represents a characteristic that might determine the appliance's choice by the user. Generally, laundry treatment devices include a casing and a front wall. Front walls made as a single integral piece, without any visible seam, so as to appear as a continuous uniform external surface, are increasingly popular and appreciated by the users.

In these front walls, also called "full front", an aperture for the loading/unloading of the appliance is generally formed, which can be preferably opened/closed by a suitable door, as well as an additional aperture, to which a control panel is associated.

As known, the control panel of an laundry treatment device typically is connected to an inner printed circuit board (or PCB) that is electrically connected to electronic components and control members, as well as a power supply, associated therewith for implementing corresponding control functionalities, e.g. powering, driving, activation, deactivation of operative loads including electric, electronic, electro-mechanical and/or electro-hydraulic parts of the appliance (such as motor, solenoid valve, further PCBs and the like).

The control panel is operated by the user by means of an outer dashboard, which also represents the external visible surface of the assembly, positioned at the front wall. On the dashboard, displays, knobs, touch screens and/or any other input devices are formed in order to control the operative status of the appliance and/or for example select the appropriate programs or cycles and the parameters thereof.

The outer dashboard is coupled to the front wall, at the aperture therein, and the PCB is located within the casing. Different couplings between the outer dashboard and the front wall are possible.

In EP 2140058, a laundry treating apparatus is provided which can be manufactured easily. The laundry treating apparatus includes a cabinet, a drum rotatably disposed in the cabinet configured to hold laundry therein, a front cover including a door aperture to load the laundry in the drum, and at least one panel aperture configured to receive a control panel therein. The control panel is mounted on the front cover by means of a mounting plate which is detachably coupled to flange parts.

SUMMARY OF SELECTED INVENTIVE ASPECTS

Applicant has considered the layout of the panel control assembly described in EP 2140058. The appliance herein disclosed includes a full front wall, in which two apertures are made, one for connecting the panel assembly and one for connecting the drawer.

Applicant has noticed that the assembly of the EP 2140058 machine is rather complex: in order to couple the control panel assembly to the machine, an accurate alignment is required and numerous pieces have to be assembled together in order to obtain the complete panel assembly. Indeed, the presence of several pieces means an increase in the assembly required time and thus an increase in the overall costs of the device.

Applicant has realized that costs are a decisive factor for the success of a laundry treatment appliance, therefore introducing further elements in the construction of the laundry treatment device could most probably increase the costs of the same. Increasing the number of components of the device not only increases costs, but also the time required for the device overall assembly and the numbers of spare parts to make available.

In addition, the full front wall of the device disclosed in the mentioned EP patent is made of metallic material. As visible from the figures, the panel aperture and the drawer aperture are separated by a crosspiece, which is also made of metallic material. The control panel is coupled to the casing of the device from the back, e.g. the panel assembly is connected to the front wall from the interior of the casing, and therefore no portion of the panel assembly is overlapping a portion of the front surface of the front wall. This in turn means that the visible and accessible parts of the crosspiece made of metal are also not covered by any additional element, and thus its edges, which are possibly sharp, can cause damage to the user who accidentally touches the same while operating the control panel.

Last but not least, changes in the layout of a "standard" device causes great influence on production, warehousing and managing cost of the control-panel assembly, and hence of the appliance.

Applicant has tackled the problem of devising a satisfactory solution able to overcome the above-discussed drawbacks.

According to a first aspect, the invention relates to a laundry treatment device comprising:

- a casing comprising a front wall defining a continuous front surface, said front surface having a laundry opening to load and/or unload a laundry treatment chamber contained in said casing, and a panel aperture, said panel aperture having an edge defining a closed curve;
- a control panel assembly for controlling operation of the laundry treatment device, said control panel assembly including an outer dashboard which is structured to be coupled to said front wall at said panel aperture and operated by a user, said outer dashboard comprising a dashboard external portion, said portion being external to the casing, visible and accessible to a user;
- a drawer and a drawer seat to house said drawer, the drawer seat being fixed or fixable to said front wall so that said drawer is coupled in a retractable manner to said front wall, wherein said drawer seat is an integral piece of said external dashboard portion, forming an outer dashboard assembly.

Preferably, the laundry treatment device is a washing machine or a dryer or a washer/dryer.

The laundry treatment device includes a casing delimiting the appliance and a front wall of the same. The front wall of the casing has a front surface which is a continuous surface having at least an aperture which is called panel aperture. This front surface represents the external front surface of the appliance, when the latter is in an assembled configuration, and it is construed as a single continuous surface holed by the panel aperture. In other words, there is a single piece of front wall which hosts, via appropriate opening, a control panel assembly. These front walls are in jargon also called "full front". However, the front wall can also include additional element(s) separated from the portion of the front wall defining the continuous front surface. As an example, the front wall could include a first portion having a panel aperture to host the control-panel assembly which is positioned in the top-most part of the front wall, and a second portion, separated from the first, which covers the lowermost part of the front wall.

The terms "top", "middle" and "bottom" or "upper" and "lower" are herein used with reference to the standard standing configuration of the laundry treatment device when in use.

The control panel assembly is manually operated by a user in order to select the programs or to input any data relative to the functioning of the appliance. The control panel assembly can also display warning messages or instruction for maintenance coming directly from the laundry treatment device.

The panel aperture includes an edge which is a closed curve, which means that the aperture is completely contained in the front wall. The shape of the aperture and/or of the edge is not relevant in the present case and it can be oval, rectangular, etc.

In addition, the front wall, in the portion defining the continuous front surface, preferably includes further apertures. As an example, the front surface includes an opening for the access into the appliance, e.g. in a washing machine or dryer the opening is used to load and/or unload the laundry.

Preferably, the front wall and the outer dashboard are made of different materials.

Advantageously, the outer dashboard includes an outer dashboard external portion, which is located, in assembled configuration, outside the casing. This dashboard external portion is the portion which preferably includes all input devices which can be used by the user to command and define the washing/drying cycles of the laundry treatment device. For example, the external portion can include knobs, touch screen, displays, etc. Preferably, said external portion defines an outer surface which, in an assembled configuration, preferably substantially forms a geometrical continuation of the front surface of the front wall, e.g. it does not protrude or sticks out in a significant manner, so that the front wall globally has a pleasant aesthetical appearance.

Moreover, the laundry treatment device includes a drawer. The drawer includes, in case of a washing machine, a detergent dispenser, e.g. the detergent is inserted within the drawer and, during the washing cycle, it is flushed within the drum by flushing water. Alternatively, the drawer is a water drawer where, in case of a dryer, the condense water is collected during the drying cycles.

The drawer is connected in a retractable manner onto the front wall of the laundry treatment device, so that a user can open and close the same in order for example to introduce the detergents and/or to remove the condense water.

For this purpose, in the laundry treatment device a seat is provided, in order to house the drawer and allow the opening and closing movements.

According to the invention, preferably the seat is an integral part of the dashboard and more preferably of the external portion of the dashboard. In other words, drawer seat and external portion of the dashboard preferably form a single integral element, which is called outer dashboard assembly.

In this way, the number of parts which are included in the panel assembly is reduced and the assembly of the laundry treatment device is simplified.

In addition, when the control panel assembly and the drawer have to be mounted onto the front wall, a correct alignment plays a critical role in order to obtain a satisfactory result. Having to align a single element onto two apertures, instead of two elements onto the same two different separated elements, again simplifies the overall assembly, reducing costs and time.

Preferably, all visible portion of said continuous front surface is seamless.

"Seamless" means in this embodiment that there are no junctions or seams in the front surface connecting different pieces together. Thus, the visible portion of the front wall is a single piece, for example a single metal sheet which has been properly shaped. The sheet has not been welded or otherwise connected. The visible portion of the front wall means that portion which, when the laundry treatment device is in an assembled configuration, is visible by the user from the outside of the casing. This portion is preferably the seamless one, because it gives a better aesthetical appearance to the laundry treatment device and in addition avoids any possibility of injuries caused by sharp edges which can occurs when seams in metal material are created (for example when the seam is unfinished by mistake). Other portions of the front wall which are covered by additional elements or which are hidden by other casing's parts can include seams.

Preferably, said outer dashboard assembly, when coupled to said panel aperture and said laundry treatment device is in an assembled configuration, is completely surrounded by said front wall.

This means that the outer dashboard assembly, i.e., including the drawer seat, is surrounded by the front wall. Surrounded can mean that the outer dashboard assembly is, in an assembled configuration, in contact to the front wall in all directions. Alternatively, there is no direct contact, but an aperture or another body is interposed between a side of the dashboard assembly and the front wall. However, from all sides the dashboard assembly is still encircled by a portion of front wall, regardless of whether the front wall is in contact or not to the dashboard assembly.

Surrounded can also mean that any portion of the dashboard assembly, not only the external part, can be completely surrounded by the front wall. For example, the dashboard assembly can include a portion external to the casing which covers the front wall to such an extension that it comes into contact to lateral wall(s) of the casing. However, being the dashboard assembly also inserted into the panel aperture, there is always a portion of dashboard which is completely surrounded from all directions by the front wall.

In other words, the outer dashboard assembly is advantageously built-in (or embedded) the front wall.

In an advantageous embodiment, said front wall includes a drawer aperture in which said drawer can be inserted.

The dashboard assembly could be inserted in a single aperture, the panel aperture, or, as in this preferred embodiment, can be coupled to two different apertures made on the front wall, a panel aperture and a drawer aperture. The latter case is preferred in order not to have a "too big hole" in the front wall of the casing which could compromise the stability of the overall front wall.

Preferably, said drawer aperture has an edge defining a closed curve.

Thus, drawer aperture and panel aperture have preferably the same structure, defining closed curves with their respective edges. Also in this case, the shape of the aperture and/or of its edge is not relevant for the present invention.

Advantageously, said panel aperture and said drawer aperture are separated by a crosspiece.

The crosspiece interposed between the two apertures helps to stabilize the front wall, creating a supporting element for the wall, and also it helps to obtain a correct alignment of the outer dashboard assembly on the front wall during the assembly of the laundry treatment device.

Preferably, said crosspiece defines a crosspiece front surface, said crosspiece front surface being a portion of said continuous front surface of said front wall. More preferably, the continuous surface made out of the front surface and crosspiece front surface is also seamless.

In this advantageous embodiment, the crosspiece is not an added element to the front wall, but it is an integral part of the same, and more preferably the front surface, which also includes the crosspiece front surface, is globally seamless.

In a different embodiment, the crosspiece can be attached to, for example by welding, the front wall, so it is a separated element that has to be assembled during the laundry treatment device production. Other means to fix the crosspiece are included as well, for example by screws, glue, snap-fit elements, etc.

Advantageously, said outer dashboard assembly includes a rear surface, a portion of said rear surface being in abutment against said crosspiece front surface when said laundry treatment device is in an assembled configuration.

In this embodiment, the crosspiece is substantially covered (or overlapped) by the dashboard assembly and thus it is not directly reachable by the user when the laundry treatment device is assembled. The crosspiece therefore is not required to have a proper finishing, such as smooth and rounded edges in order not to injure the user. Indeed, a not covered crosspiece with sharp edges can cut the user's fingers when he/she is operating the dashboard to input some information on the same.

More preferably, said rear surface of the dashboard assembly, when said laundry treatment device is in an assembled configuration, extends in front of said panel aperture and said crosspiece.

The dashboard assembly thus includes a rear surface which preferably covers both panel aperture and crosspiece as a single element.

In a preferred embodiment, said outer dashboard assembly is coupled to said crosspiece by means of a crosspiece mechanical coupling.

It is preferred to couple the outer dashboard assembly to the crosspiece in order to simplify the alignment of the outer dashboard assembly and in particular of its visible portion on the front wall. Preferably, a mechanical coupling is used.

More preferably, said crosspiece mechanical coupling includes a screw, screw threads formed on said outer dashboard and a hole formed on said crosspiece.

A screw coupling is particularly effective in case of vibrations, such as those present in a laundry treatment device during washing and/or rinsing cycles, and remains fastened also under these conditions.

Advantageously, said drawer seat is coupled to an edge of said drawer aperture by means of a drawer seat mechanical coupling.

More preferably, said drawer seat mechanical coupling includes a screw coupling element.

To further strengthen the coupling between the dashboard assembly and the front wall of the laundry treatment device, the drawer seat is also coupled to the drawer aperture.

In an advantageous embodiment, a vertical section of said front wall presents a concavity pointed towards the internal of said casing.

The shape of the front wall is not flat, but substantially curved. The curvature is along a vertical plane, according to a favorite embodiment, so that the front wall has a rounded appearance which is particularly pleasant and appreciated by the user. In this curved front wall, the dashboard assembly of the invention fits easily due to the fact that preferably the outer surface of the dashboard substantially represents a geometrical continuation of the front surface of the front wall without protruding from the same, i.e., forming a surface substantially flush to the front wall surface.

In an embodiment, said outer dashboard assembly is made in a plastic material and said front wall is made in a metallic material.

Preferably, the front wall of full front laundry treatment devices is made of metal. The full front shape is relatively easily retrievable by suitably bending a sheet of metallic material, such as steel. On the other hand, preferably the dashboard assembly is made of plastic material, because the coupling between plastic and metal is more reliable and easy to be manufactured than a metal to metal connection.

BRIEF DESCRIPTION OF THE DRAWINGS

Further features and advantages of the present invention shall become clearer from the following detailed description of a preferred embodiment thereof, made with reference to the attached drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In such drawings.

DETAILED DESCRIPTION OF EXAMPLE EMBODIMENTS

Figure 1:
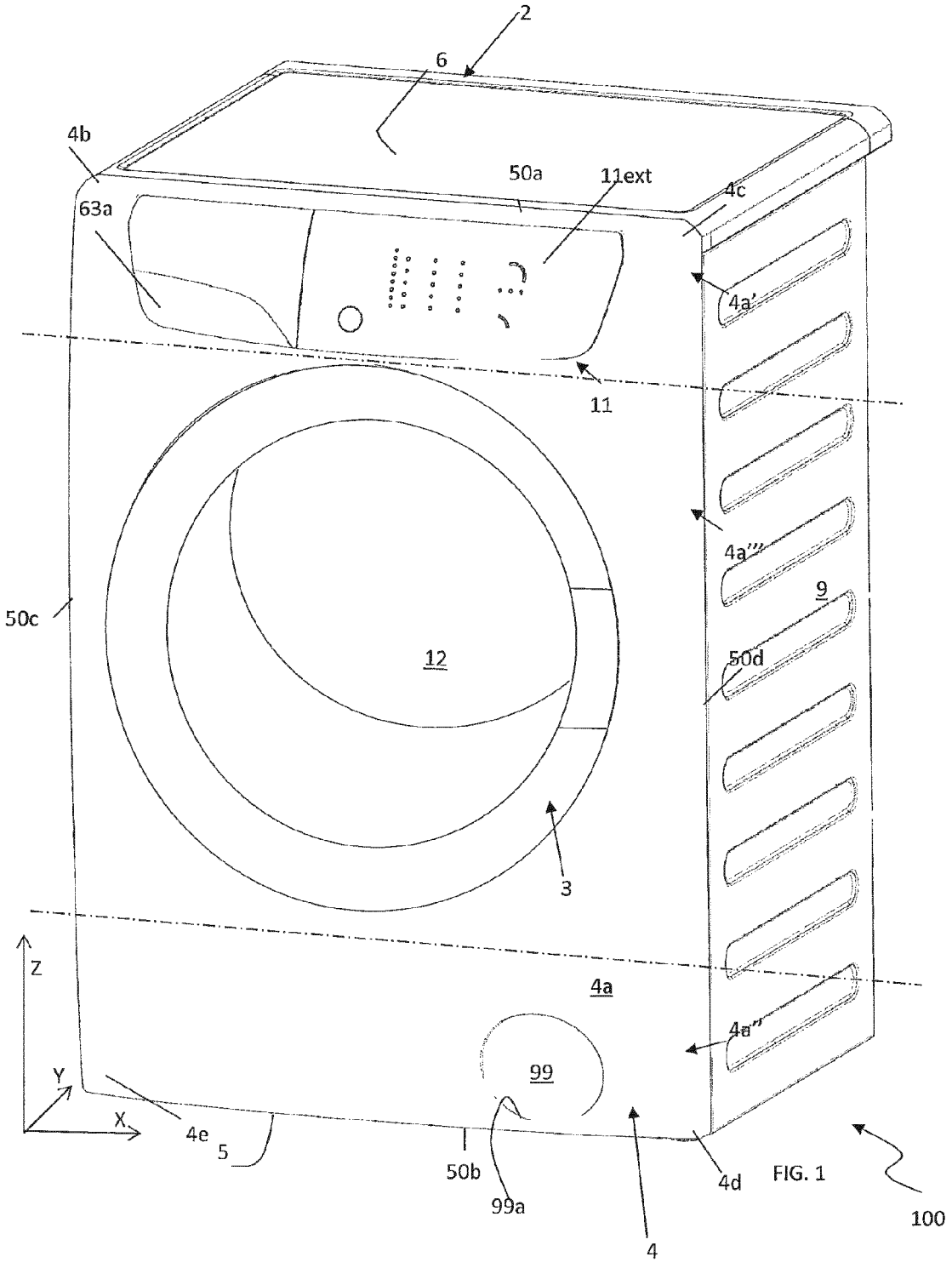
FIG. 1 schematically shows a perspective view of a laundry treatment device according to the invention.

Referring to the drawings, FIG. 1 schematically shows a perspective view of a laundry treatment device 100 according to the present invention.

As it will be better understood by the following description, the teaching of the present invention may be applied to substantially any appliance for laundry treatment, e.g. to washer/dryers, washing machines (as exemplary illustrated in the figures and to which reference will be made in the following by way of a non-limiting example only), dryers, etc.

The device 100 comprises a substantially parallelepiped-shaped casing 2, which encloses an inner compartment comprising a laundry treatment chamber, for example a rotating drum 12 for housing the laundry to be treated and a tub encasing the drum (tub is not visible in the appended drawings). Moreover, the device includes an access door 3 provided on a front wall 4 of the casing for accessing the laundry treatment chamber 12 thereby allowing loading/unloading of the laundry by a user. The front wall 4 is connected to an open side of casing 2.

The casing 2, with now reference to FIGS. 1-6, preferably also includes a bottom wall or basement 5, a top wall 6, a back wall 7, and two opposite lateral walls 8, 9. Preferably, lateral walls, front walls, top wall and basement are separated pieces which are then assembled together via suitable fastening means. However, it is also encompassed by the present invention that some of these walls can be a single piece, for example lateral walls and back wall can be a single U-shaped piece.

Moreover, casing 2 may include a single wall, or two walls, such as the back and/or one of the side walls. In other words, casing and front wall together defines a substantially close volume, regardless of the relative extension of front wall and the rest of the casing.

Walls are preferably made of metal, however also plastic is possible. Also, in a non-depicted embodiment, some of the walls can be made of a material, and some other(s) can be made of a different material.

Figure 3:
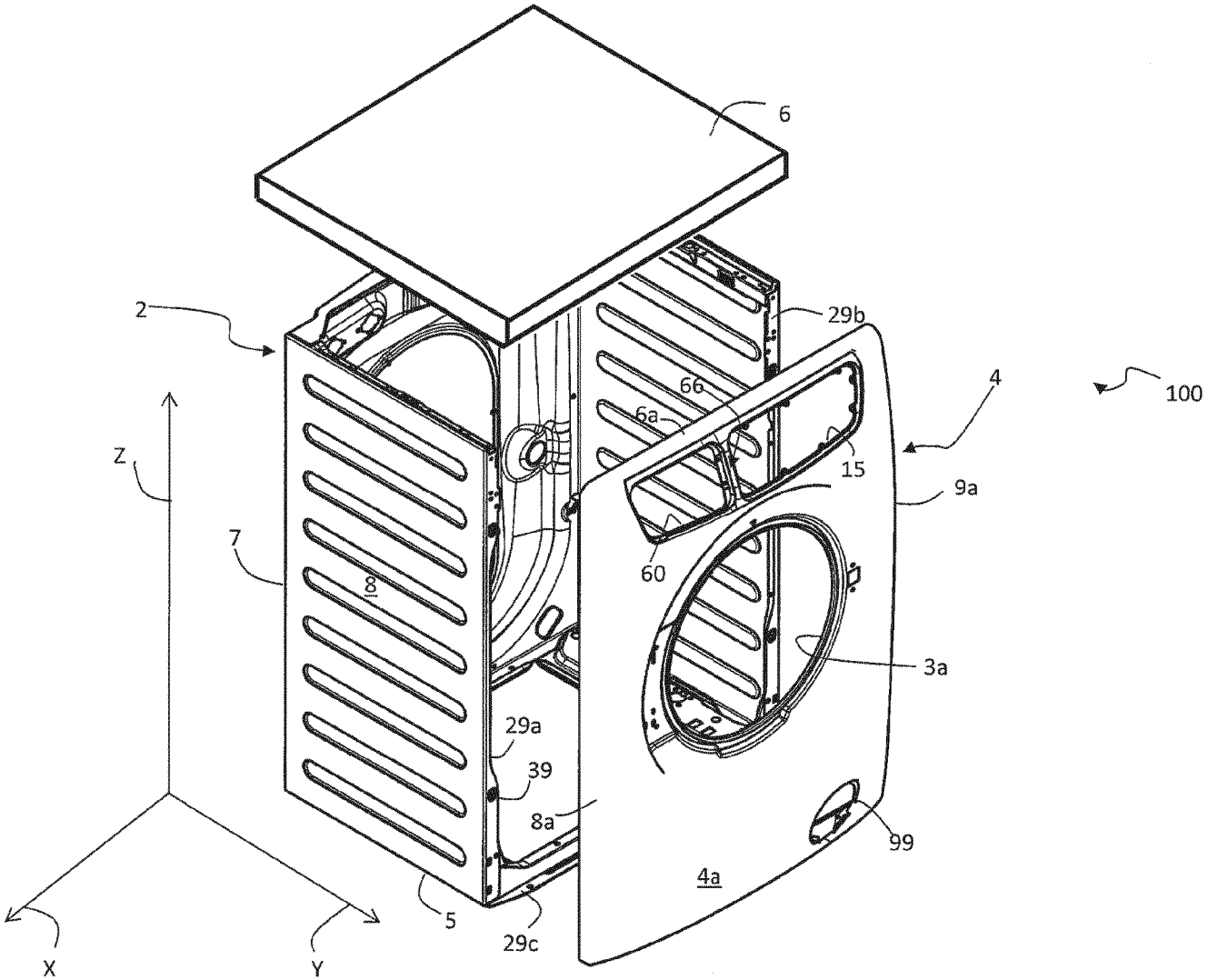
FIG. 3 shows a perspective view of a casing of the laundry treatment device of FIGS. 1-2 in a disassembled configuration.

By the device 100 itself, in a standard operative position, a horizontal plane is defined (plane (XY) in FIGS. 1 and 3), which is generally the plane on which the bottom wall or basement 5 lies and generally it is also parallel to the top wall 6 of the casing in a mounted configuration. The appliance also extends along a vertical direction denoted with Z.

In a preferred embodiment, the front wall 4 includes an external continuous surface 4*a* having a plurality of apertures, as better detailed below. According to a preferred embodiment, the front external surface is the external front surface of the appliance.

Front wall 4 is preferably made of a metallic material, for example in stainless steel.

The front surface 4*a* is preferably continuous and even more preferably seamless, at least in the visible portion(s) of the same. Continuous surface means that the surface is formed as a single member. "Seamless" means that, in addition to be continuous, there are no seams which indicate that for example welding has been used to join together different parts. In the covered (i.e., not visible from outside of the laundry treatment device 100 in the assembled condition of the latter) portions of the front wall 4, seams can be present. The absence of seams improves the overall appearance of the laundry treatment device 100.

In addition, the front wall 4 preferably includes four rounded corners 4*b*, 4*c*, 4*d*, 4*e* along its outer edge. "Rounded corner" means a corner which does not include sharp and abrupt changes in directions of the surfaces forming the same; on the contrary in a rounded corner the surfaces merges smoothly and with continuity. The round corners give a more aesthetically pleasant look to the device 100.

In an embodiment of the invention, the front wall 4 can be obtained by a single sheet of metal. For example, it can be obtained by a sheet of stainless steel. In addition, the front wall can be coated by suitable coating to prevent corrosion. Moreover, the front wall can be colored of any color and gloss.

Preferably, the front wall 4 defines a top portion 4*a*', a middle portion 4*a*''' and a bottom portion 4*a*'', the terms "top", "middle" and "bottom" used with reference to the standard standing configuration of the household appliance when in use.

In a preferred embodiment, not depicted in the drawings, only the top portion 4*a*' and the middle portion 4*a*''' of the front wall 4 are a single (or one-piece) element, i.e., having a continuous and/or seamless front surface 4*a*, while the bottom portion 4*a*'' can be permanently fixed to it, for example welded to it, or it can even be added as an additional element which can be disassembled from the rest of the front wall.

In addition, the front wall 4 includes an outer edge which can be divided in a top edge 50*a*, which is the portion of the outer edge comprised between corners 4*b* and 4*c*, a bottom edge 50*b*, which is the portion of the edge located between corners 4*d* and 4*e*, and two lateral opposite edges, 50*c* and 50*d*, which are the portions of outer edge present between corners 4*b* and 4*e*, and 4*c* and 4*d*, respectively.

Front surface 4*a* includes a laundry opening 3*a* for the access into the laundry treatment device 100, in particular to the laundry treatment chamber 12 so that laundry can be loaded or unloaded to/from the laundry treatment device 100. The opening 3*a* is openable and closable by the door 3, which is advantageously hinged on front wall 4.

Preferably, the door 3 is coupled to a recessed portion 3*b* of the front wall 4*a*: in this embodiment, the front wall 4 includes the recessed portion (see FIGS. 3 and 4) in the center of which the door opening 3*a* is formed. The dimensions of the opening 3*a* are such to be suitable to accommodate the door 3. The door 3 is then rotatably coupled to the door opening 3*a* and, when mounted and in a closed position, it preferably does not project substantially beyond the front surface 4*a* due to the recess presence. In other words, an outer surface of door 3 matches the front surface 4*a* of front wall 4.

Preferably, but not necessarily, the door 3 and the recessed portion 3*b* are located in the middle portion 4*a*''' of the front wall 4.

Advantageously, the front wall 4 is not flat, i.e., it does not lie completely on a single plane. On the contrary, it preferably includes a concavity pointing towards the inside of the casing 2, being convex on the outside. In the depicted embodiment, better visible in the side view of FIG. 5, the front wall 4—in a section along plane parallel to plane (Z, Y)—has substantially a smoothed trapezoidal shape, the top 4*a*', the bottom 4*a*'' and the middle portion 4*a*''' lying on three different planes which form an angle one with respect to the other(s) and also with the vertical direction Z defined by the casing 2, forming in this way the inward concavity. The three planes are preferably connected smoothly and without sharp corners, as clearly visible in FIG. 5. However, other layouts of the front wall 4 are possible as well, for example the front wall can include a substantially constant curvature, the concavity still oriented towards the inside of the casing 2. For example, the front wall could be a portion of a cylindrical mantel.

Preferably, a first and a second side walls 8*a*, 9*a* are connected to the front wall 4, extending from its side edges 50*c* and 50*d* delimited between corners 4*b*-4*e* and 4*c*-4*d*, respectively. When the laundry treatment device is in assembled configuration, i.e., when all elements of the casing 2 are mounted, the side walls 8*a*, 9*a* are substantially a geometrical continuation of the lateral walls 8, 9, respectively, of casing 2. More preferably, side walls 8*a*, 9*a* and front wall 4 are formed continuously as one body, i.e., they are not an assembly of different pieces but they are integral one to the others, and more preferably there are no seams of welding separating the front from the side walls. Side walls and front walls are thus formed as a single piece and even more preferably the front surface 4*a* of the front wall is smoothly connected to the front surfaces of the side walls 8*a* and 9*a*, e.g. no sharp curvature changes are present.

Preferably, also an upper wall 6*a* and a bottom wall 5*a* extend from the top and bottom edge, 50*a* and 50*b*, respectively, of the front wall. Preferably, upper wall and bottom wall are continuous with the front wall. In this way, corners 4*b*, 4*c*, 4*d*, 4*e* formed where side walls and upper/bottom walls merge into the front wall are seamless, because they are not formed by joining different elements, but they are formed during a single process of forming of the front wall, for example by pressing a single metallic sheet.

The two side walls 8*a*, 9*a* extend from the side edges 50*c* and 50*d* of the front wall 4 substantially perpendicularly to the front wall 4 towards the lateral walls 8 and 9 respectively, or the casing 2, so as to be aligned to these lateral walls. Analogously, also upper and bottom walls 6*a*, 5*a* extend from the top edge 50*a* and bottom edge 50*b* substantially perpendicularly to the front wall 4, respectively towards the top and bottom walls 6,5 of the casing, preferably so as to be aligned with the latter. At least one of bottom wall 5*a* and side walls 8*a*, 9*a*, more preferably all of them, includes a flange to secure the front wall 4 to the rest of the casing 2.

Preferably, at least a flange extends, departing from one of the side walls 8*a*, 9*a* or bottom wall 5*a*, substantially perpendicularly to the side walls 8*a*, 9*a*, or bottom wall 5*a*, from which it departs. More preferably, from each of the side walls 8*a*, 9*a* and bottom wall 5*a*, a flange departs, respectively called side flanges 19*a*, 19*b*, and bottom flange 19*c*. At least one, preferably all, flange 19*a*, 19*b*, 19*c*, abuts against a corresponding flange 29*a*, 29*b*, 29*c*, present on the casing 2. The casing flange 29*a*, 29*b*, 29*c* are located at lateral walls 8, 9 and bottom wall (or basement) 5. Flanges can be formed continuously with the wall from which they extend, or they can be welded to the same. In a different embodiment, only some of the flanges are formed continuously while others are fixed to the front wall 4. Flanges 19*a*, 19*b*, 19*c*, 29*a*, 29*b*, 29*c* are not visible from the outside of the device 100 when the front wall 4 is assembled to the rest of the casing 2, being hidden inside the casing 2 in an assembled configuration itself.

Preferably, flanges 19*a*, 19*b*, 19*c*, 29*a*, 29*b*, 29*c* include coupling holes, all indicated with 39 in the appended drawings, in order to couple the flanges 19*a*, 19*b*, 19*c* of walls 5*a*, 8*a*, 9*a* to the flanges 29*a*, 29*b*, 29*c*, so that the front wall 4 is coupled to the rest of the casing 2 via suitable fastening elements (not visible) inserted or otherwise coupled to the holes 39.

Top wall 6*a* includes preferably appendices 19*d* and corresponding holes 39 for the connection to the casing 2.

Further, front wall 4 includes a second aperture 15, called panel aperture. Preferably, the front wall 4 includes also a third aperture, called drawer aperture 60.

Preferably, the panel aperture 15 and/or the drawer aperture 60 is (are) located at the top portion 4*a*' of the front wall.

Figure 4:
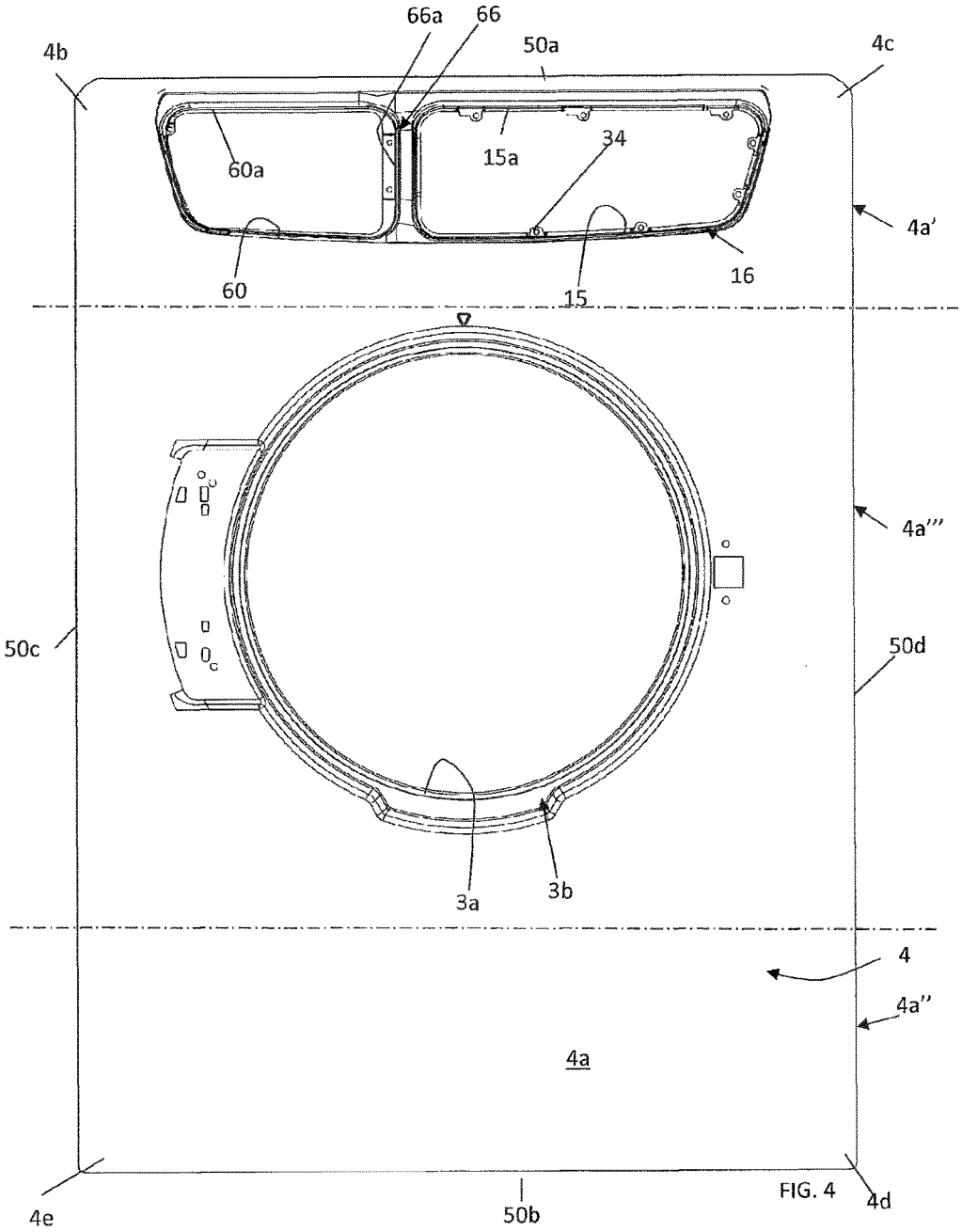
FIG. 4 is a front view of the casing of FIG. 3.
Figure 5:
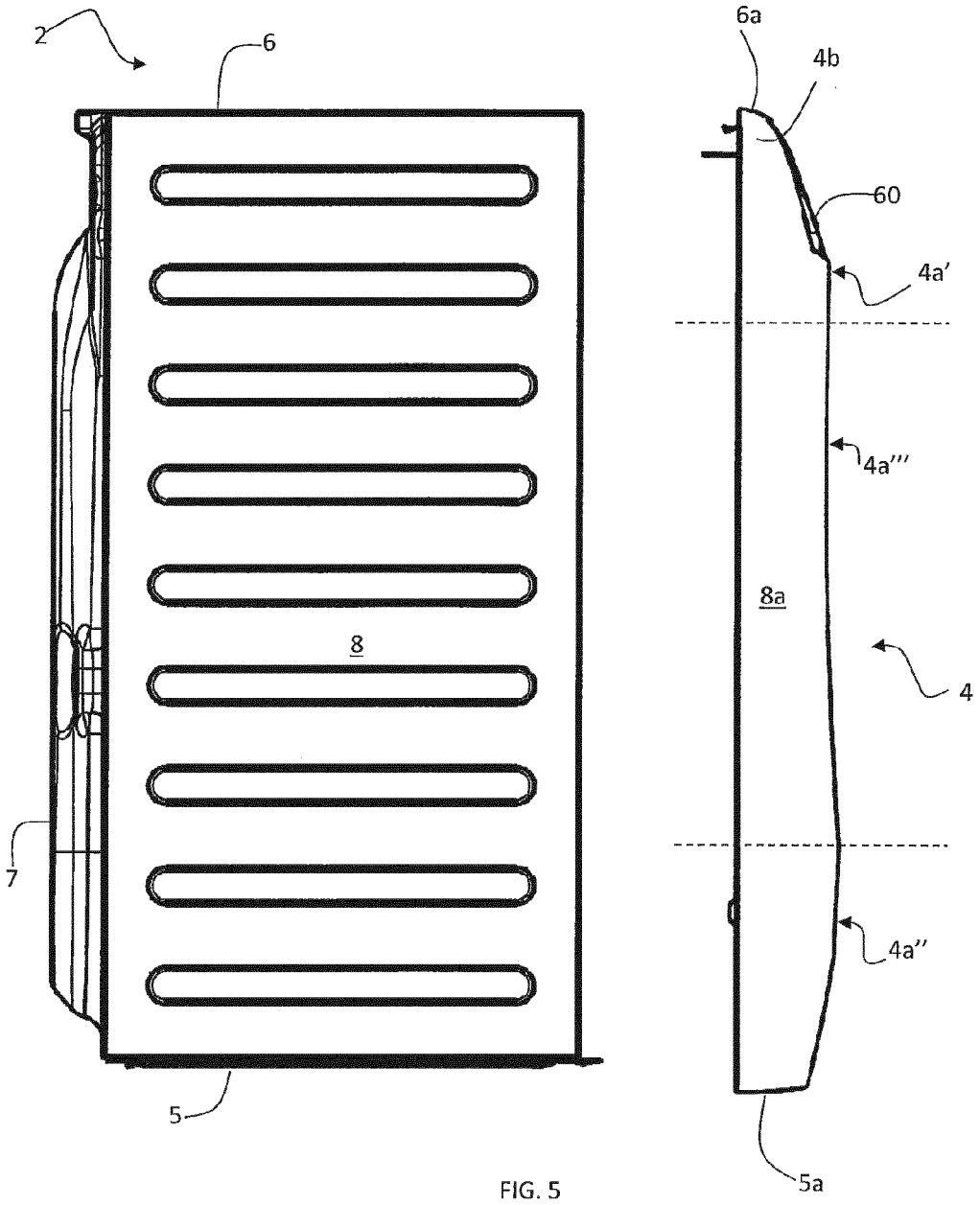
FIG. 5 is a lateral view of the casing of FIG. 3.
Figure 6:
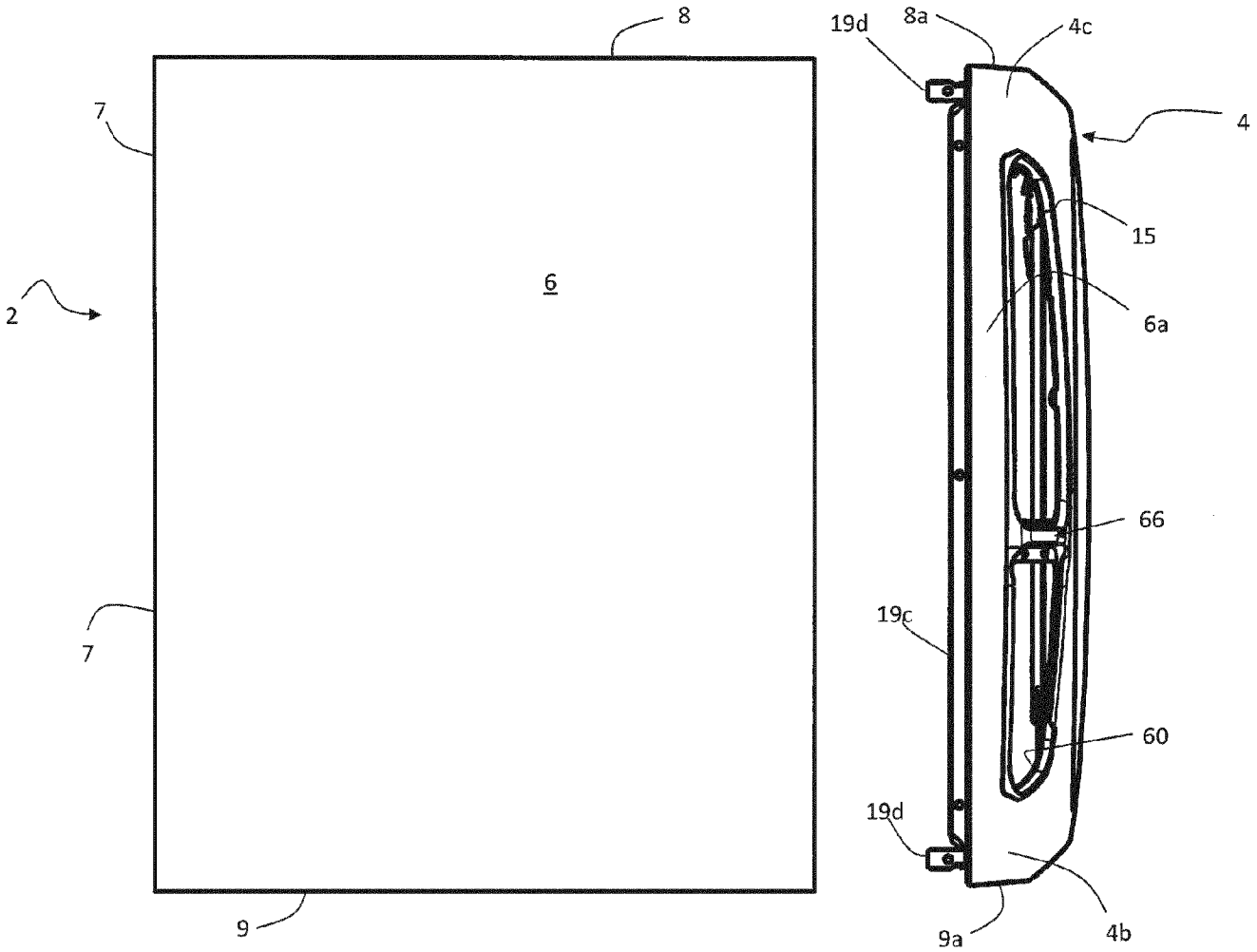
FIG. 6 is a top view of casing of FIG. 3.

In a preferred embodiment, better visible in FIGS. 3 and 4, the panel aperture 15 and the drawer aperture 60 are each substantially a through hole within the front wall, in other words the panel aperture and/or the drawer aperture is(are) completely surrounded in all directions by the front wall. In this way, the panel aperture 15 and/or the drawer aperture 60 includes each an outer edge, 15*a* and 60*a*, respectively, which defines a closed curve, such as a loop.

Preferably, panel aperture 15 and drawer aperture 60 are located one adjacent to the other substantially at the same height along the Z direction on the front wall 4.

A crosspiece 66 advantageously separates the panel aperture 15 from the drawer aperture 60 (and vice-versa). As visible in the figures, preferably the crosspiece 66 has an elongated shape with a first and a second opposite longitudinal ends 66*b*, 66*c* and has a longitudinal extension substantially parallel to the vertical axis Z. Crosspiece 66 includes a portion of the edge 60*a* of the drawer aperture 60 and a portion of the edge 15*a* of the panel aperture 15*a*, corresponding to its lateral opposite edges. Furthermore, crosspiece 66 includes a front surface 66*a* which is oriented towards the outside of the casing 2 in an assembled configuration.

In a preferred embodiment, the front surface 66*a* of the crosspiece 66 and the front surface 4*a* of the front wall 4 are a continuous uniform surface, and even more preferably this continuous uniform surface is also seamless. In this case, the crosspiece 66 is substantially an integral part of the front wall 4: in the front wall 4 there are two apertures, the drawer and panel aperture 15, 60, and the crosspiece is the "remaining" portion of front wall (for example during a punching procedure of a metal sheet for obtaining the apertures) between the two.

In a different embodiment, not visible in the drawings, the crosspiece 66 is attached, for example by means of its opposite longitudinal ends 66*b*, 66*c*, to the front wall separating the two apertures 60, 15. In this case, the crosspiece is not an integral piece to the front wall, but a separated element which is then fixed to the front wall 4.

In a different embodiment, not shown, drawer aperture and panel aperture might be the same aperture, e.g. a single "bigger" aperture can be obtained on the front wall, having the function of the panel and drawer apertures.

Preferably, but not necessarily, the front wall may comprise a service aperture 99, preferably covered by a service aperture cover 99*a*, so that a filter (not visible) of the laundry treatment device 100 might be easily accessible. Preferably, the service aperture 99 is provided at the bottom portion 4*a*" of the front wall 4.

Laundry treatment device 100 further includes a panel control assembly 1.

Figure 2:
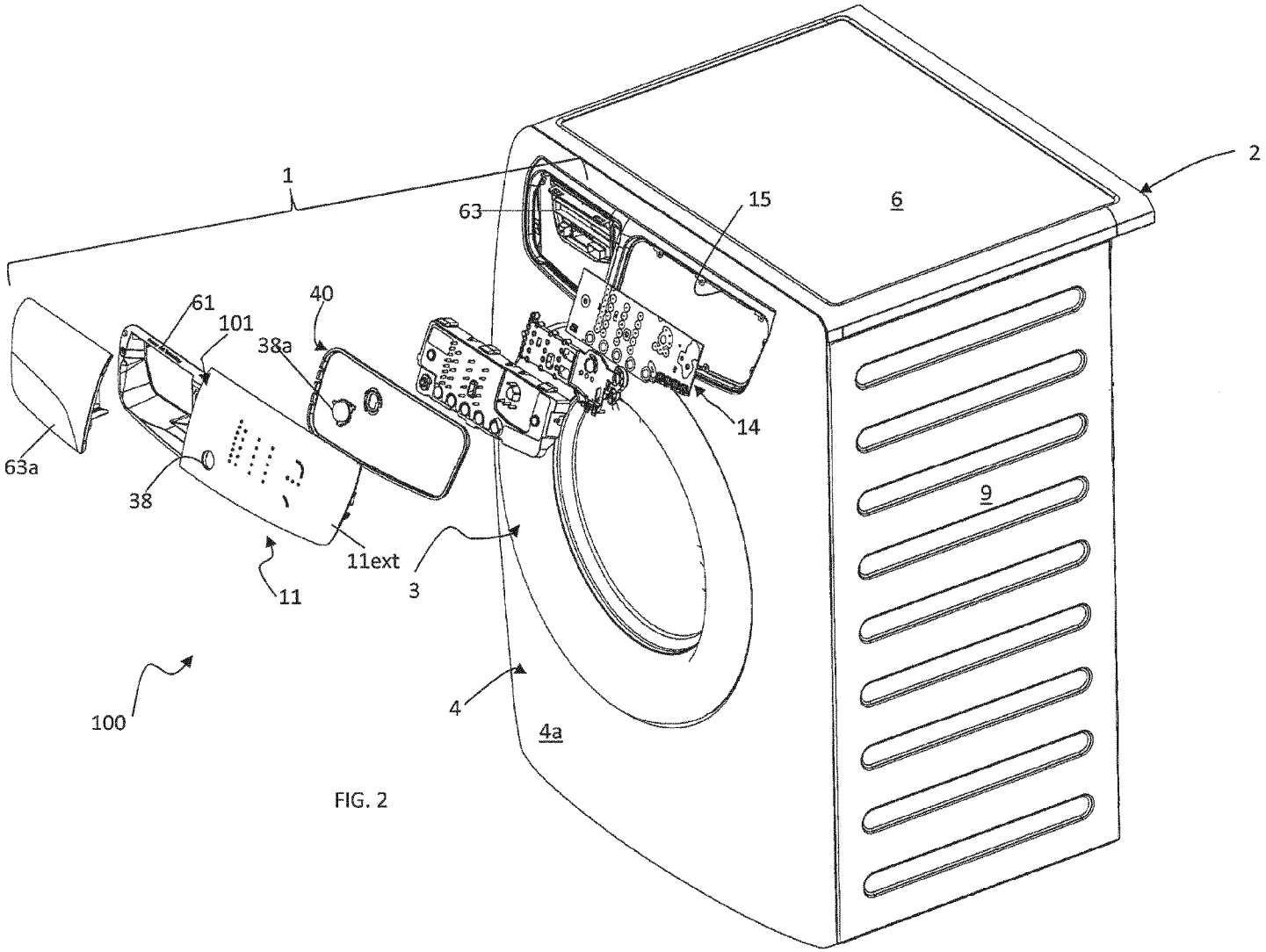
FIG. 2 shows a perspective view of the laundry treatment device of FIG. 1 wherein the panel control assembly is in a disassembled configuration.

In FIG. 2 an exemplary control panel assembly 1 in accordance to the invention is shown. The control panel assembly 1 includes an outer dashboard 11, which in the depicted embodiment spans for most of the width of the front surface 4*a* of the appliance. Preferably, although not necessarily, the dashboard is substantially a basin-shaped rigid shell, which is structured for being coupled to the outer front wall 4 of the appliance. Preferably, the dashboard 11 is made of plastic material.

The dashboard 11 is preferably configured for allowing the user to manually control operation of the appliance and ascertain an operational state thereof. The dashboard includes a portion 11*ext*, external to the casing 2, which is the portion of the dashboard 11 visible and operable by the user. The dashboard external portion 11*ext* is an exposed part of the control panel assembly also when the device 100 is fully assembled. The dashboard external portion 11*ext* includes a plurality of apertures and/or input areas 38 through which manually-operable control members 38*a* are visible or operable.

For example, received within, or in registry with, the various apertures 38 formed in the dashboard external portion 11*ext*, there are a main push button used as a main power control, a plurality of operation push-buttons, control knobs and illumination elements. Although not depicted, the dashboard external portion 11*ext* might include also a display screen and one or more control knobs.

The control knob might be rotatable in order to permit the user to select operation cycle settings and other control parameters, with reference to selections indicated by words, icons or other indicia that may be arranged, in printed form or otherwise, on the dashboard.

Apertures 38 in the dashboard, for example covered by a transparent plastic cover, can also render visible illumination of elements (also called light indicators) to provide a visual indication of a particular operation selection corresponding to a knob or push button position. Alternatively, illumination of elements may indicate the current operation state in the case of a progressive wash/dry operation comprising multiple sequential cycles or stages.

In the depicted embodiment, the dashboard advantageously includes several arrays of apertures for different light indicators. The light visible within the aperture could be either present or absent, in an on/off manner, or follow a determined pattern, e.g. blinking, can have different intensity, or can change color. The light coming from different apertures can also have different intensity or color one from the other(s).

Push buttons, display and apertures to visualize light indicators are known in the art and will not be further detailed below.

Outer dashboard 11 also includes a rear surface 11*r* facing the casing 2, when device 100 is in an assembled configuration. In the latter configuration, the rear surface 11*r* is located in front of the panel aperture 15 substantially covering (or overlapping) the same. Rear surface 11*r* is preferably substantially flat.

As visible from the perspective exploded view of the control panel assembly 1 in FIG. 2, the control panel assembly 1 also includes a printed circuit board (PCB) 14 for electrically connecting, on a corresponding active surface thereof, the rotatable knobs, the buttons, the display, etc., mentioned with reference to the dashboard.

Moreover, as generally known in the art, the PCB electrically connects functional components, e.g. electronic circuitry components (not visible in the figures), for implementing corresponding control functionalities of the control panel assembly. Such functionalities can be one or more of powering, driving, activation, deactivation of one or more operative load including electric, electronic, electro-mechanical and/or electro-hydraulic parts of the appliance, such as motor(s), solenoid valve(s), further PCB, all not shown.

PCB 14 is connected to the rear surface 11*r* once the control panel assembly is in an assembled configuration, and when the control panel assembly 1 is mounted on casing 2 in an assembled configuration, it is located internally to the casing 2.

Many other elements can be included in the panel control assembly as well, which are not relevant for the present invention.

Control panel assembly 1 is coupled to the front wall 4 at the panel aperture 15. The PCB 14 and other possible elements are inserted into the aperture 15. The outer dashboard 11 is then fastened onto the front wall 4. The external portion 11*ext* preferably remains outside the casing 2 and front wall 4, for example abutting onto the front surface 4*a* and/or onto the edge 15*a* of the aperture 15.

Figure 7:
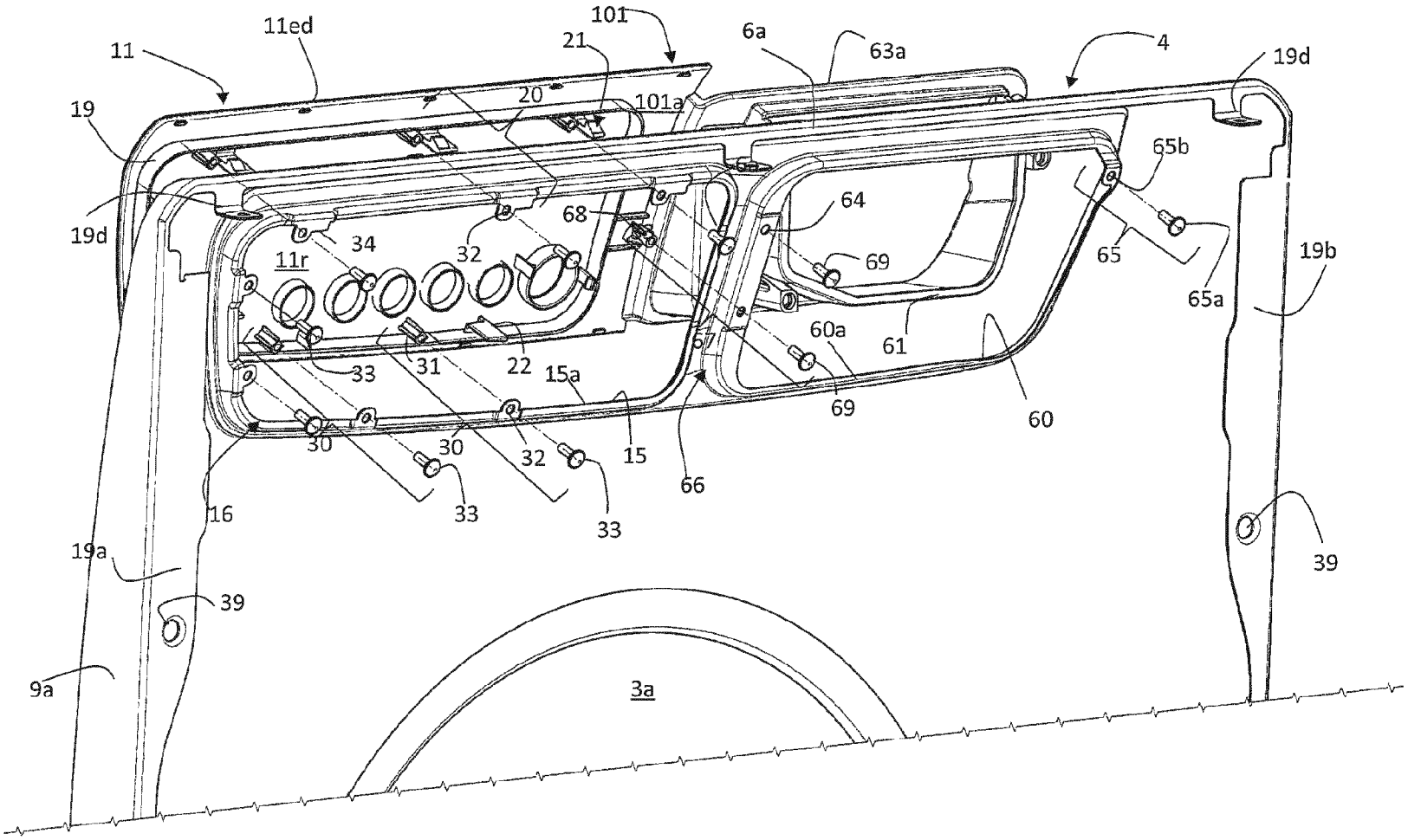
FIGS. 7-9 show three different perspective views of the coupling of an outer dashboard to the front wall of the laundry treatment device of FIGS. 1-6.
Figure 8:
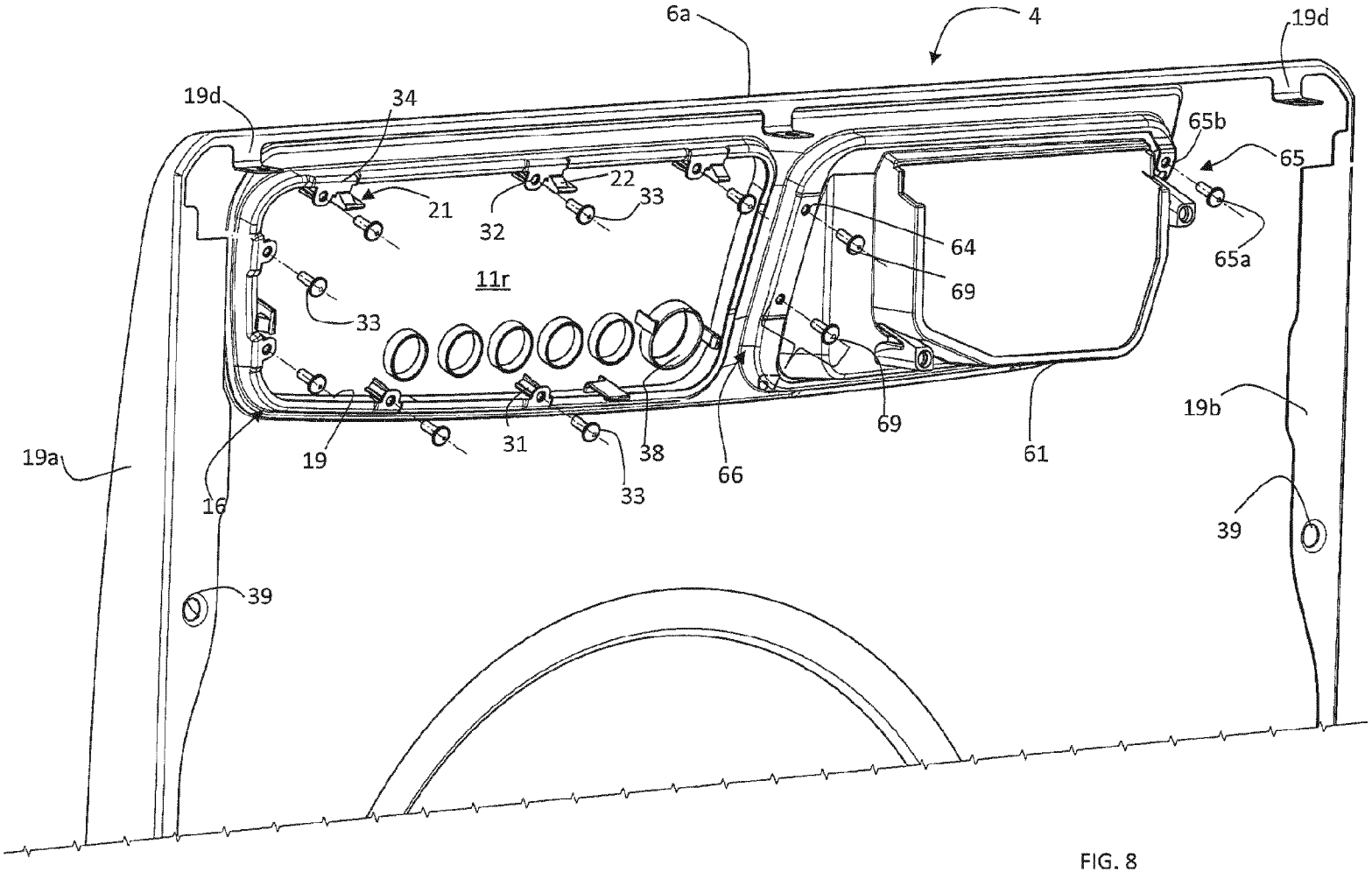
Figure 9:
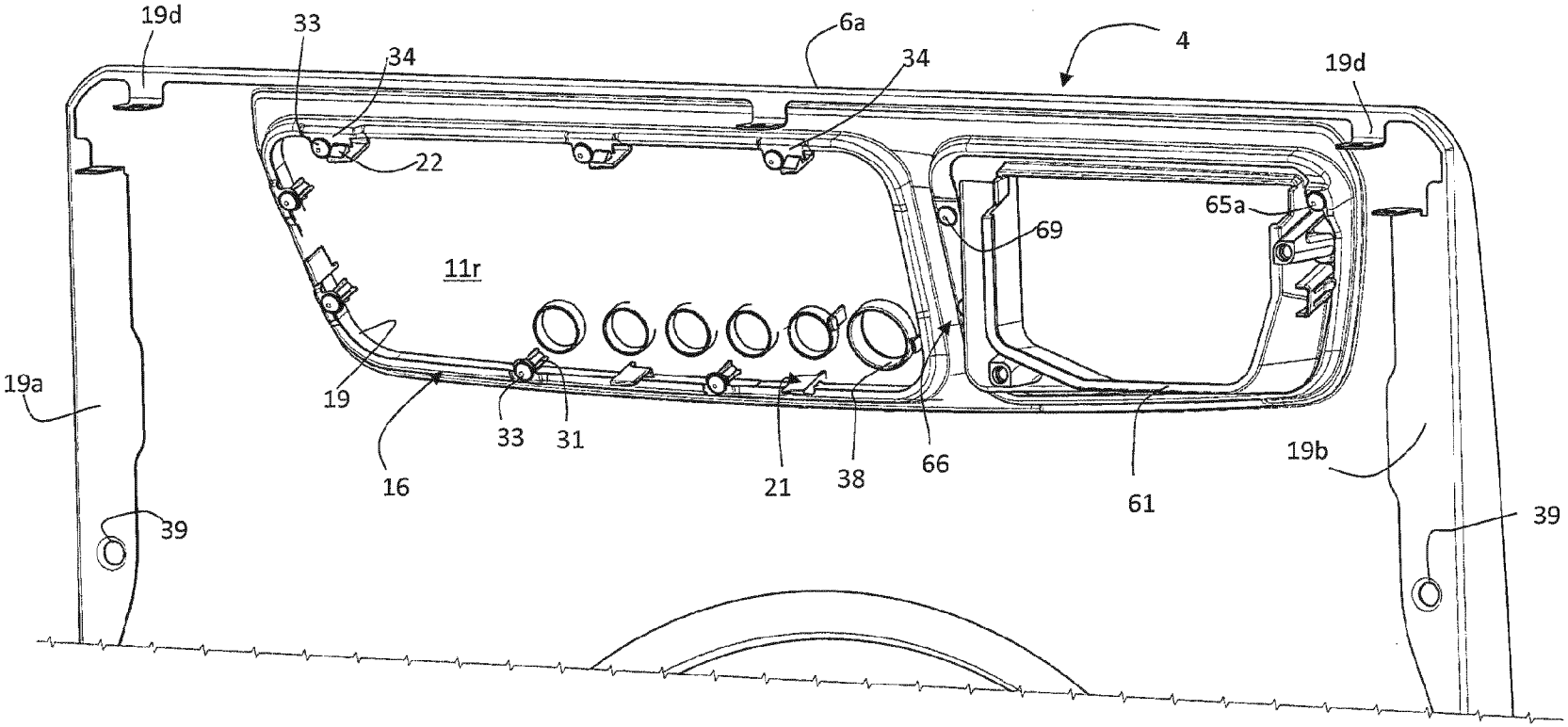

With now reference to FIGS. 7-9, in order to securely fasten the control panel assembly 1 to the panel aperture 15, first and second mechanical elements 20, 30 are preferably used, such as screws or snap-fit elements, so that the control panel is attached to the panel aperture, and preferably to the edge 15*a* of the same, in a firm manner, withstanding also possible device's vibrations present during the washing and/or rinsing cycles.

In the depicted embodiment, the first mechanical element 20 advantageously includes one or more snap-on tongues 22 provided on the dashboard 11 and a corresponding flange 16 formed around the edge 15*a* of said panel aperture 15, so that the tongues 22 can clip on the flange 16.

Moreover, the second mechanical element 30 includes screw threads 31 provided in the rear surface 11*r* of the dashboard 11, a hole 32 provided in the flange 16 formed around the panel aperture 15, and a screw 33 which is inserted in said hole and screwed in said threads to tighten a coupling of a second type with respect to the snap-on coupling provided by tongues 22.

First and second mechanical elements are visible in FIGS. 7-9. However any other type of "double coupling" is feasible as well. In addition, a single mechanical coupling system can be used to fasten the control panel assembly 1 to the panel aperture 15.

Furthermore, with reference still to FIGS. 7-9, the outer dashboard 11 is preferably fastened to the crosspiece 66 via a first mechanical coupling system 67. The crosspiece 66 itself comprises at least an element, part or portion of such first mechanical coupling system. In this specific embodiment, the crosspiece includes a hole 64 of the first mechanical coupling system 67, on which a screw 69 is inserted and fastened into a screw thread 68 provided on the rear surface 11*a* of the outer dashboard 11. More preferably, two holes 64, one on top of the other in the vertical direction Z are provided also on the crosspiece 66, on which two screws are inserted, which are then screwed into two screw threads formed on the rear surface 11*r* of the outer dashboard.

Other mechanical coupling systems can be used as well, as long as the crosspiece includes a part of the system to fasten the dashboard to itself.

When the dashboard 11 is coupled to the front wall at the panel aperture 15, there is at least a portion of the dashboard 11 which is completely surrounded by the front wall. In other words, the front wall 4 embraces at least a portion of the dashboard which, in all possible directions, is embraced by the front wall. As better visible in FIGS. 7-9, the dashboard 11 includes, extending from its rear surface 11*r*, a flange or ridge 19 which is inserted in the aperture. The flange 19 is abutting against the edge 15*a* of aperture 15 and it is completely surrounded by the same, e.g. in the depicted embodiment the portion of the dashboard called flange 19 is completely surrounded by the front wall 4 and in particular by the edge 15*a* (part of front wall).

In a different embodiment, not shown in the figures, in which there is no crosspiece 66 separating panel aperture and drawer aperture, a wider aperture is present to house both control panel and drawer. In this embodiment, on the side of the flange 19 where in the previous embodiment the crosspiece was present, now a portion of the aperture is present for housing the drawer. Also in this embodiment, the dashboard is still surrounded in all directions by the front wall, because beyond the portion of aperture, along a horizontal axis for example, a piece on front wall is still present, the piece of front wall which forms the edge of the "wider" aperture.

In a further embodiment, not shown, the external portion of the dashboard extend along the front surface and can cover the front wall 4 up to the casing 2 in one or more some directions. For example, the external portion of the dashboard 11*ext* can reach one (or more) of the casing lateral walls 8 or 9, or the casing's top wall 6, if it extends along a horizontal, or vertical, direction, thus without leaving portions of the front wall between the dashboard and the casing visible in that direction. However the dashboard is still completely surrounded by the front wall also in this embodiment, due to the fact that the flange 19 is still inserted in aperture 15 and thus edge 15*a* completely surrounds the flange 19.

Preferably, when the dashboard 11 is coupled to the front wall 4 and it is inserted partly in the casing 2, the external portion 11*ext* of the dashboard 11 is flush-mounted on the front wall 4, being flush with the front surface 4*a*. The aesthetical appearance of the assembled dashboard 11 on the front wall 4 is that of a substantially continuous surface where the external portion 11*ext* matches the external surface 4*a* of front wall 4.

Laundry treatment device 100 also includes a detergent drawer 63. Detergent drawer 63 is retractably mounted to said front wall 4 so that it can be opened and closed. The detergent drawer is generally used to introduce detergents or other products in order to perform a proper washing cycle. Detergent drawer includes a detergent drawer front wall 63*a*, which also remains external to the casing 2 when the laundry treatment device is in an assembled configuration, and it is so shaped to be easily gripped by the user in order to open and/or close the drawer 63.

Drawer 63 is coupled to drawer aperture 60 of front wall 4. In order to couple the drawer to the front wall 4 in a retractable manner, a drawer seat 61 is provided, whose dimensions are optimal to house the drawer 63 in a slidable manner. The drawer seat 61 is thus fixed to the front wall 4 at the drawer aperture 60.

Drawer seat 61 is preferably made of plastic material.

Drawer seat 61, after being mounted on the drawer aperture 60, is then covered by the drawer front wall 63*a* so that drawer seat becomes substantially invisible when the laundry treatment device 100 is in an assembled configuration. Drawer front wall 63*a* thus is positioned in front of the drawer aperture 60 closing the same. Preferably, the front wall 63*a* of the drawer is mounted on the drawer seat so that it is substantially flush-mounted to the front wall, i.e., the front surface 4*a* of the front wall is substantially flush with a front surface of the drawer front wall 63*a*.

In an alternative embodiment, non-depicted in the drawings, a single "larger" aperture is provided, as mentioned previously, to house both the control panel assembly 1 and, adjacent to the latter, the detergent drawer 63 (so the crosspiece is not present).

With now reference to FIGS. 7-9, the fastening of the dashboard and the drawer seat to the front wall is shown.

Drawer seat 61 is inserted into drawer aperture 60 and then fixed to the same. In order to fix the drawer seat 61 to the front wall 4, a mechanical coupling 65 is used. Mechanical coupling 65 includes for example a screw 65*a* inserted into a hole 65*b* provided in proximity of the edge 60*a* of the drawer aperture 60. The screw 65*a* is thus screwed into a screw thread (not shown) of the drawer seat 61. Any other mechanical coupling can be used as well, in order to firmly fasten the drawer seat to the drawer aperture 60, preferably in proximity of the drawer aperture edge 60*a*.

The drawer seat 61 is also preferably fastened to the crosspiece 66 via a second mechanical coupling system 67. The crosspiece 66 itself comprises at least an element of such second mechanical system. In this specific embodiment, the crosspiece 66 includes a hole 64 of the second mechanical coupling system, on which a screw 69 is inserted and fastened into a screw thread 68 provided in the rear surface 11*a* of the drawer seat 61. More preferably, two holes 64, one on top of the other in the vertical direction Z are present at crosspiece 66, on which two screws are inserted, which are then screwed into two screw threads.

In the depicted embodiment, drawer seat 61 and the external portion 11*ext* of the outer dashboard 11 form an integral piece, forming an outer dashboard assembly. Therefore, first and second mechanical systems 67 are a single system, because fastening of one of the dashboard and drawer seat to the crosspiece automatically means fastening the other of the drawer seat and dashboard to the crosspiece.

However, a non-depicted embodiment in which the drawer seat and the dashboard are separated elements one from the other and independently fixed to the crosspiece via different first and second coupling systems is envisaged as well by the present invention. Moreover, first and second mechanical coupling systems can be different one from the other, for example one of them might include a snap-fit system and the other one a screw coupling system. In all cases, the crosspiece includes a part of both the first and second mechanical coupling system.

Preferably, the external portion 11*ext* of the dashboard 11 and drawer seat 61 are molded together and are made of plastic material.

A connecting element, called bridge 101, joins together the dashboard external portion 11*ext* and the drawer seat 61. Bridge 101 is preferably located outside the casing 2 when the laundry treatment device is in an assembled configuration and it is positioned in front of the crosspiece 66. The bridge 101 includes a cover surface 101*a*, which is not visible to a user from the outside of the casing when the control panel assembly 1 is in an assembled configuration and connected to the front wall 4.

Cover surface 101*a* can be a portion of the rear surface 11*r* of dashboard 11 or a different separated surface. Cover surface, as the name suggests, covers the crosspiece 66, and preferably the front surface 66*a* of the same.

In the embodiment in which the drawer seat and the dashboard external portion are two different separated elements, the cover surface 101*a* can alternatively be included in the drawer seat 61 or in the dashboard 11 and its function is still the same, to cover the front surface 66*a* of the crosspiece 66.

Preferably, the cover surface 101*a* is in abutment against the front surface 66*a* of the crosspiece.

General operation of the laundry treatment device 100 is substantially identical to that of a conventional laundry treatment device, therefore no further explanation is required.

It has thus been shown that the present invention allows all the set objects to be achieved.

Clearly, changes may be made to the rotatable drum and to the laundry treating machine (including such a rotatable drum) as described herein.

Although an illustrative embodiment of the present invention have been described herein with reference to the attached drawings, it is to be understood that the present invention is not limited to the specific embodiment illustrated and described herein, and that various other changes and modifications may be affected therein by one skilled in the art without departing from the scope of the invention. All such changes and modifications are intended to be included within the scope of the invention as defined by the following claims.

The invention claimed is:

1. A laundry treatment device comprising:

a casing comprising a front wall defining a continuous front surface, said front surface having a laundry opening to load or unload a laundry treatment chamber contained in said casing, said casing comprising a panel aperture, said panel aperture having an edge defining a closed curve;

a control panel assembly for controlling operation of the laundry treatment device, said control panel assembly including an outer dashboard which is structured to be coupled to said front wall at said panel aperture and to be operated by a user, said outer dashboard including a rear surface facing the casing, wherein in an assembled configuration, said rear surface being located in front of, and covering or overlapping, the panel aperture, said outer dashboard further comprising an external dashboard portion, said external dashboard portion being, in an assembled configuration, external to the casing, visible and accessible to a user;

a drawer and a drawer seat to house said drawer, the drawer seat being fixed or fixable to said front wall so that said drawer is coupled in a retractable manner to said front wall, wherein said drawer seat and said external dashboard portion are a single integral piece forming an outer dashboard assembly.

2. The laundry treatment device according to claim 1, wherein the entire visible portion of said continuous front surface is seamless.

3. The laundry treatment device according to claim 1, wherein said outer dashboard assembly, when coupled to said panel aperture and when said laundry treatment device is in an assembled configuration, is completely surrounded by said front wall.

4. The laundry treatment device according to claim 1, wherein said front wall includes a drawer aperture in which said drawer can be inserted.

5. The laundry treatment device according to claim 4, wherein said drawer aperture has an edge defining a closed curve.

6. The laundry treatment device according to claim 4, wherein said panel aperture and said drawer aperture are separated by a crosspiece.

7. The laundry treatment device according to claim 6, wherein said crosspiece defines a crosspiece front surface, said crosspiece front surface being a portion of said continuous front surface of said front wall.

8. The laundry treatment device according to claim 6, wherein a portion of said rear surface being in abutment against said crosspiece front surface, when said laundry treatment device is in an assembled configuration.

9. The laundry treatment device according to claim 8, wherein said rear surface, when said laundry treatment device is in an assembled configuration, is in front of or overlaps said panel aperture and said crosspiece.

10. The laundry treatment device according to claim 6, wherein said outer dashboard assembly is coupled to said crosspiece by means of a crosspiece mechanical coupling.

11. The laundry treatment device according to claim 10, wherein said crosspiece mechanical coupling includes a screw, screw threads formed on said outer dashboard assembly and a hole formed on said crosspiece.

12. The laundry treatment device according to claim 6, wherein said crosspiece is a separated element fixed or fixable to said front wall to separate said panel aperture and said drawing aperture.

13. The laundry treatment device according to claim 4, wherein said drawer seat is coupled to an edge of said drawer aperture by means of a drawer seat mechanical coupling.

14. The laundry treatment device according to claim 13, wherein said drawer seat mechanical coupling includes a screw coupling element.

15. The laundry treatment device according to claim 1, wherein the entire visible portion of said continuous front surface is seamless, said front wall includes a drawer aperture in which said drawer can be inserted, and said panel aperture and said drawer aperture are separated by a crosspiece.

* * * * *